US005940059A

United States Patent [19]

Lee et al.

[11] Patent Number: 5,940,059

[45] Date of Patent: Aug. 17, 1999

[54] THIN-FILM TRANSISTOR LIQUID CRYSTAL DISPLAY DEVICES HAVING HIGH RESOLUTION

[75] Inventors: Gyu-su Lee; Dong-gyu Kim, both of Kyungki-do, Rep. of Korea

[73] Assignee: Samsung Electronics Co., Ltd., Rep. of Korea

[21] Appl. No.: 08/808,340

[22] Filed: Feb. 28, 1997

[30] Foreign Application Priority Data

Feb. 28, 1996 [KR] Rep. of Korea ..... 96-5055

[51] Int. Cl.[6] ..... G09G 3/36

[52] U.S. Cl. ..... 345/91; 345/90; 345/98

[58] Field of Search ..... 345/87, 90–92, 345/98, 100

[56] References Cited

U.S. PATENT DOCUMENTS

| | | | |
|---|---|---|---|
| 4,870,399 | 9/1989 | Carlson | 345/100 |
| 4,954,789 | 9/1990 | Sampsell | 359/318 |
| 5,475,396 | 12/1995 | Kitajima et al. | 345/92 |
| 5,497,146 | 3/1996 | Hebiguchi | 345/92 |
| 5,517,342 | 5/1996 | Kim et al. | 359/59 |
| 5,608,421 | 3/1997 | Okada | 345/98 |
| 5,745,090 | 4/1998 | Kim et al. | 345/90 |

*Primary Examiner*—Amare Mengistu
*Assistant Examiner*—Ricardo Osorio
*Attorney, Agent, or Firm*—Myers Bigel Sibley & Sajovec

[57] ABSTRACT

Liquid crystal display devices include a first row of viewable liquid crystal display cells having data inputs electrically connected to a plurality of data lines (D1-Dn), control gates commonly connected to a first gate line (e.g., G1) and storage capacitors (Cst) having first electrodes electrically connected to a zeroth gate line (e.g., G0). A second row of viewable liquid crystal display cells are also provided having data inputs electrically connected to a plurality of data lines (D1-Dn), control gates commonly connected to a second gate line (e.g., G2) and storage capacitors (Cst) having first electrodes electrically connected to a first gate line (e.g., G1). Moreover, to maintain the RC delay value of the zeroth gate line at a level equal to the RC delay values associated with the higher order gate lines (e.g., G1-Gn), a row of nonviewable or "dummy" liquid crystal display cells are provided having data inputs electrically connected to the plurality of data lines, control gates commonly connected to the zeroth gate line and storage capacitors having first electrodes electrically coupled together. This row of nonviewable cells are provided to "mimic" a row of viewable cells so that the RC delay values associated with the zeroth gate line equals the RC delay value associated with the other gate lines in the array. The row of nonviewable cells may also be replaced by a variable resistance device (e.g., potentiometer, resistor ladder, etc.) and a variable capacitance device which are electrically coupled in series between the zeroth gate line and respective reference potentials (e.g., Vcom, GND, etc.). These variable devices are adjusted so that the total effective RC delay values associated with the zeroth gate line equals the RC delay value associated with the other gate lines.

4 Claims, 4 Drawing Sheets

THIN-FILM TRANSISTOR LIQUID CRYSTAL DISPLAY DEVICES HAVING HIGH RESOLUTION

FIELD OF THE INVENTION

The present invention relates to display devices, and more particularly to liquid crystal display devices.

BACKGROUND OF THE INVENTION

In order to minimize the space required by display devices, research into the development of various flat panel display devices such as LCD display devices, plasma display panels (PDP) and electro-luminescence displays (EL), has been undertaken to displace larger cathode-ray tube displays (CRT) as the most commonly used display devices. Particularly, in the case of LCD display devices, liquid crystal technology has been explored because the optical characteristics of liquid crystal material can be controlled in response to changes in electric fields applied thereto. As will be understood by those skilled in the art, a thin film transistor liquid crystal display (TFT LCD) typically uses a thin film transistor as a switching device and the electrical-optical effect of liquid crystal molecules to display data visually.

At present, the dominant methods for fabricating liquid crystal display devices and panels are typically methods based on amorphous silicon (a-Si) thin film transistor technologies. Using these technologies, high quality image displays of substantial size can be fabricated using low temperature processes. As will be understood by those skilled in the art, conventional LCD devices typically include a transparent (e.g., glass) substrate with an array of thin film transistors thereon, pixel electrodes, orthogonal gate and data lines, a color filter substrate and liquid crystal material between the transparent substrate and color filter substrate. The use of a-Si TFT technology typically also requires the use of separate peripheral integrated circuitry to drive the gates and sources (i.e., data inputs) of the TFTs in the array. In particular, gate driving signals from a gate driving integrated circuit are typically transmitted to the gate electrodes of TFTs in respective rows and data driving signals from a data driving integrated circuit are typically transmitted to the source electrodes of TFTs in respective columns. A display is typically composed of a TFT substrate in which a plurality of liquid crystal pixels are formed. Each pixel typically has at least one TFT and a pixel electrode coupled to the drain of the respective TFT. Accordingly, the application of a gate driving signal to the gate of a TFT will electrically connect the pixel electrode of a respective TFT to the data line connected thereto.

Referring to now to FIG. 1, a first conventional TFT LCD display device is illustrated comprising an array of TFT LCD display cells and gate and data driving ICs. In particular, a two-dimensional array of display cells are illustrated. Each cell comprises a TFT transistor having a source electrode connected to a data line (D1-Dn), a gate electrode connected to a gate line (G1-Gn) and a drain electrode connected to a respective pixel electrode internal to the cell. As will be understood by those skilled in the art, storage capacitors (Cst), liquid crystal capacitors (Clc) and gate-drain capacitors (Cgd) may be provided in each cell. As illustrated, the liquid crystal capacitors are connected in series between respective pixel electrodes and a common reference potential (Vcom) and the storage capacitors in each row of cells are connected in series between respective pixel electrodes and a next lower order gate line. For example, a storage capacitor in a first row of cells has first and second electrodes connected to a zeroth gate line GO and an internal pixel electrode, respectively. As illustrated by the device of FIG. 1, the zeroth gate line GO is not independently controlled but, instead, is electrically connected to the second gate line G2. Unfortunately, because the RC delay value associated with the zeroth gate line is unequal to the RC delay value associated with the first gate line G1 (and Gn-1 and Gn), the performance of the display device is deteriorated.

Referring now to FIG. 2, a second conventional TFT LCD display device is illustrated. This device of FIG. 2 is similar to the device of FIG. 1, however, the zeroth gate line GO is connected to a common reference potential (Vcom) instead of another gate line. Unfortunately, the RC delay value associated with the zeroth gate line GO can typically vary by about 10% from the RC delay values associated with the other gate lines, and this variation can also limit the performance of the display device.

Accordingly, notwithstanding the above described display devices, there still continues to be a need for improved display devices which are not limited by RC delay value variation.

SUMMARY OF THE INVENTION

It is therefore an object of the present invention to provide improved liquid crystal display (LCD) devices.

It is another object of the present invention to provide liquid crystal display devices with reduced susceptibility to display deterioration caused by RC delay value variation.

These and other objects, advantages and features of the present invention are provided by liquid crystal display devices which configure the gate lines so that the RC delay values associated therewith are equal. According to one embodiment of the present invention, a first row of viewable liquid crystal display cells are provided having data inputs electrically connected to a plurality of data lines (D1-Dn), control gates commonly connected to a first gate line (e.g., G1) and storage capacitors (Cst) having first electrodes electrically connected to a zeroth gate line (e.g., G0). A second row of viewable liquid crystal display cells are also provided having data inputs electrically connected to a plurality of data lines (D1-Dn), control gates commonly connected to a second gate line (e.g., G2) and storage capacitors (Cst) having first electrodes electrically connected to the first gate line (e.g., G1). Moreover, to maintain the RC delay value of the zeroth gate line at a level equal to the RC delay values associated with the higher order gate lines (e.g., G1-Gn), a row of nonviewable or "dummy" liquid crystal display cells are provided having data inputs electrically connected to the plurality of data lines, control gates commonly connected to the zeroth gate line and storage capacitors having first electrodes electrically coupled together. Thus, a row of nonviewable cells are provided to "mimic" a row of viewable cells so that the RC delay values associated with the zeroth gate line equals the RC delay value associated with the other gate lines in the array. According to another aspect of this first embodiment, the first electrodes of the storage capacitors may be coupled together and to a reference signal line (e.g., Vcom) or they may float electrically relative to the zeroth gate line GO and high order gate lines G1-Gn.

According to a second embodiment of the present invention, the row of nonviewable cells from the first embodiment may be replaced by a variable resistance device (e.g., potentiometer, resistor ladder, etc.) and a variable capacitance device. These devices are electrically coupled in series between the zeroth gate line and respective reference potentials (e.g., Vcom, GND, etc.). These variable devices are adjusted so that the total effective RC delay value associated with the zeroth gate line can be made equal to the RC delay values associated with the other gate lines. Preferably, the variable resistance and capacitance devices are provided external to a display panel comprising the array of display cells.

DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
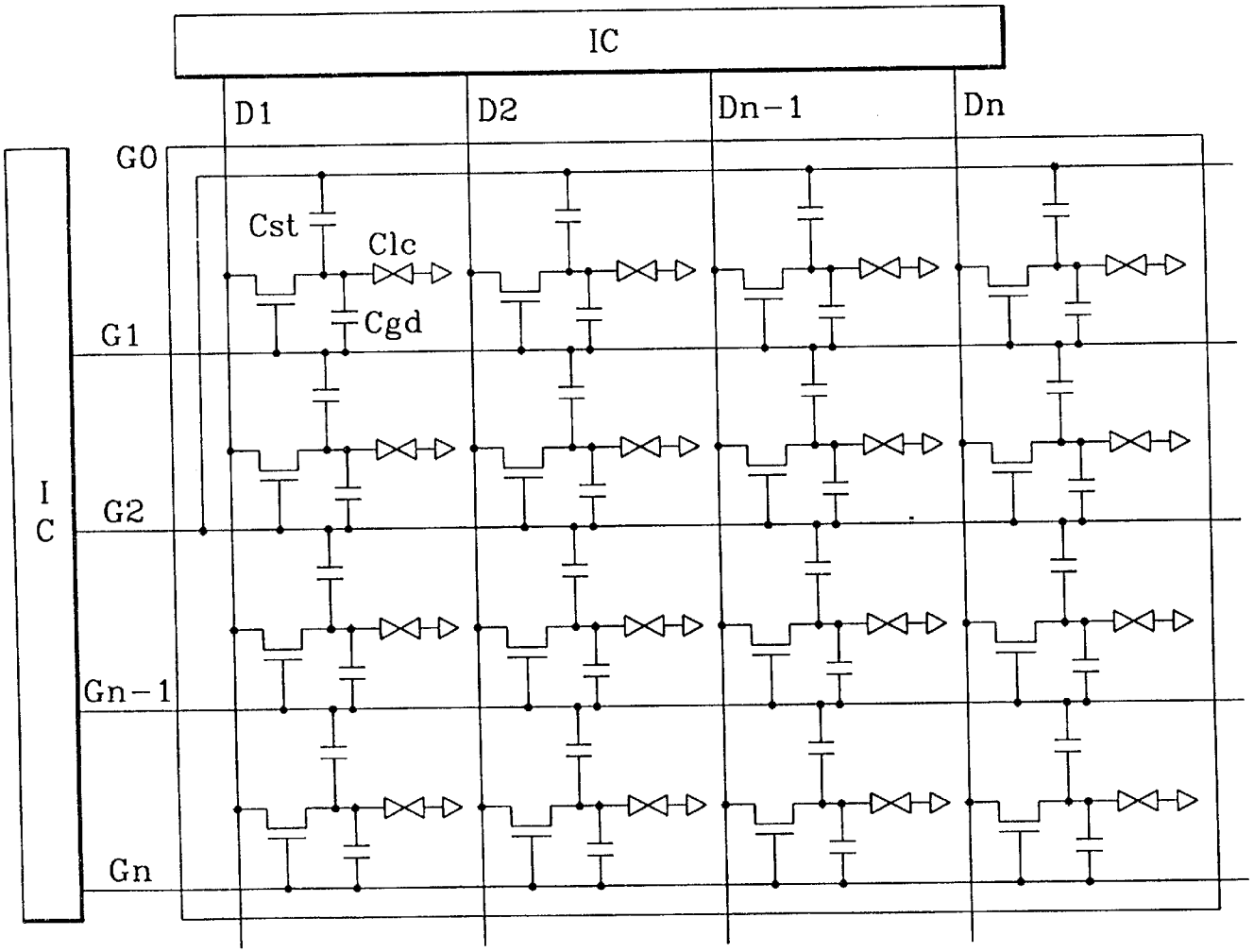
FIG. 1 (PRIOR ART)
FIG. 1 is an electrical schematic of a conventional TFT LCD display device.
Figure 2:
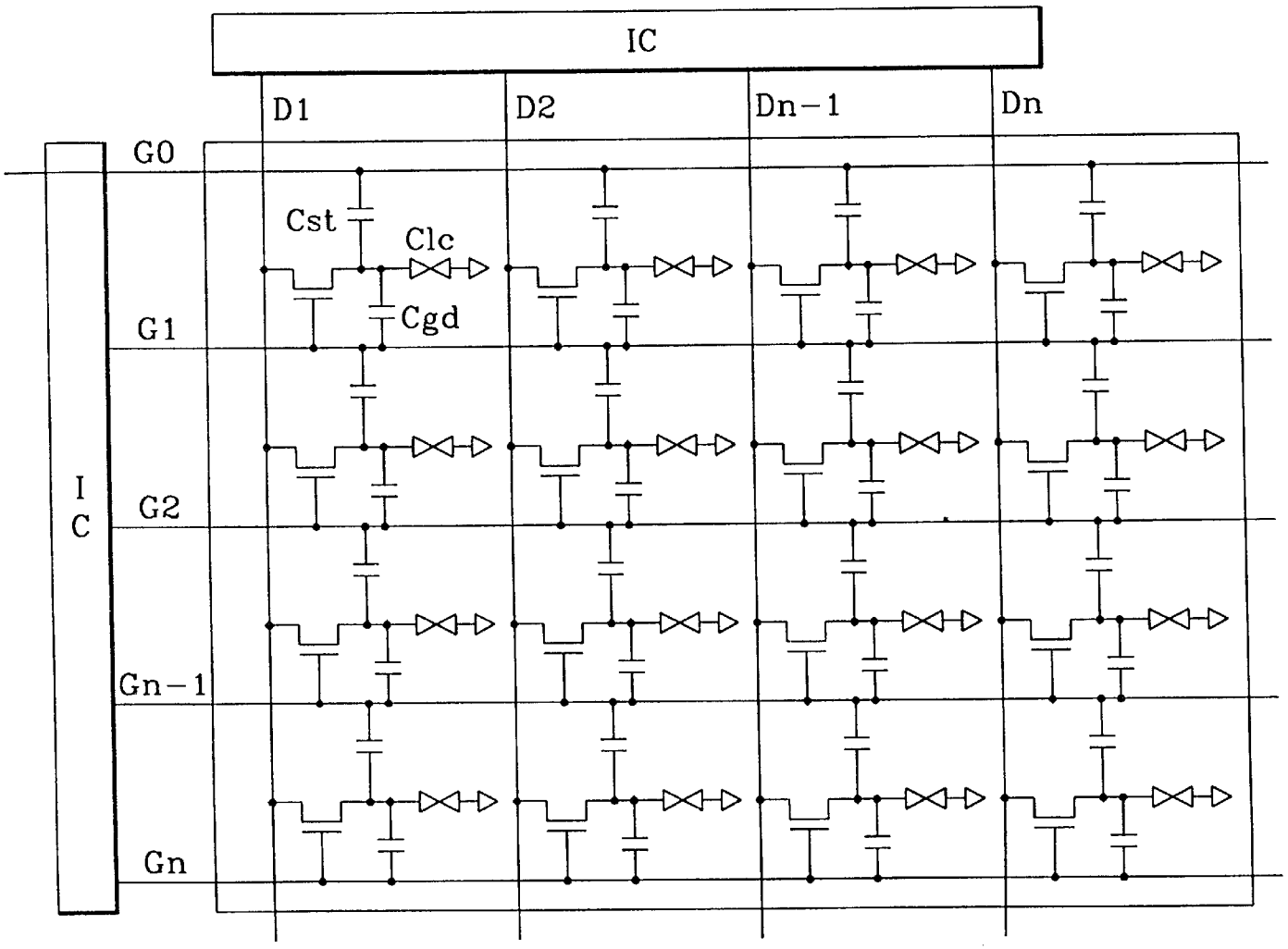
FIG.2 (PRIOR ART)
FIG. 2 is another electrical schematic of a conventional TFT LCD display device.
Figure 3:
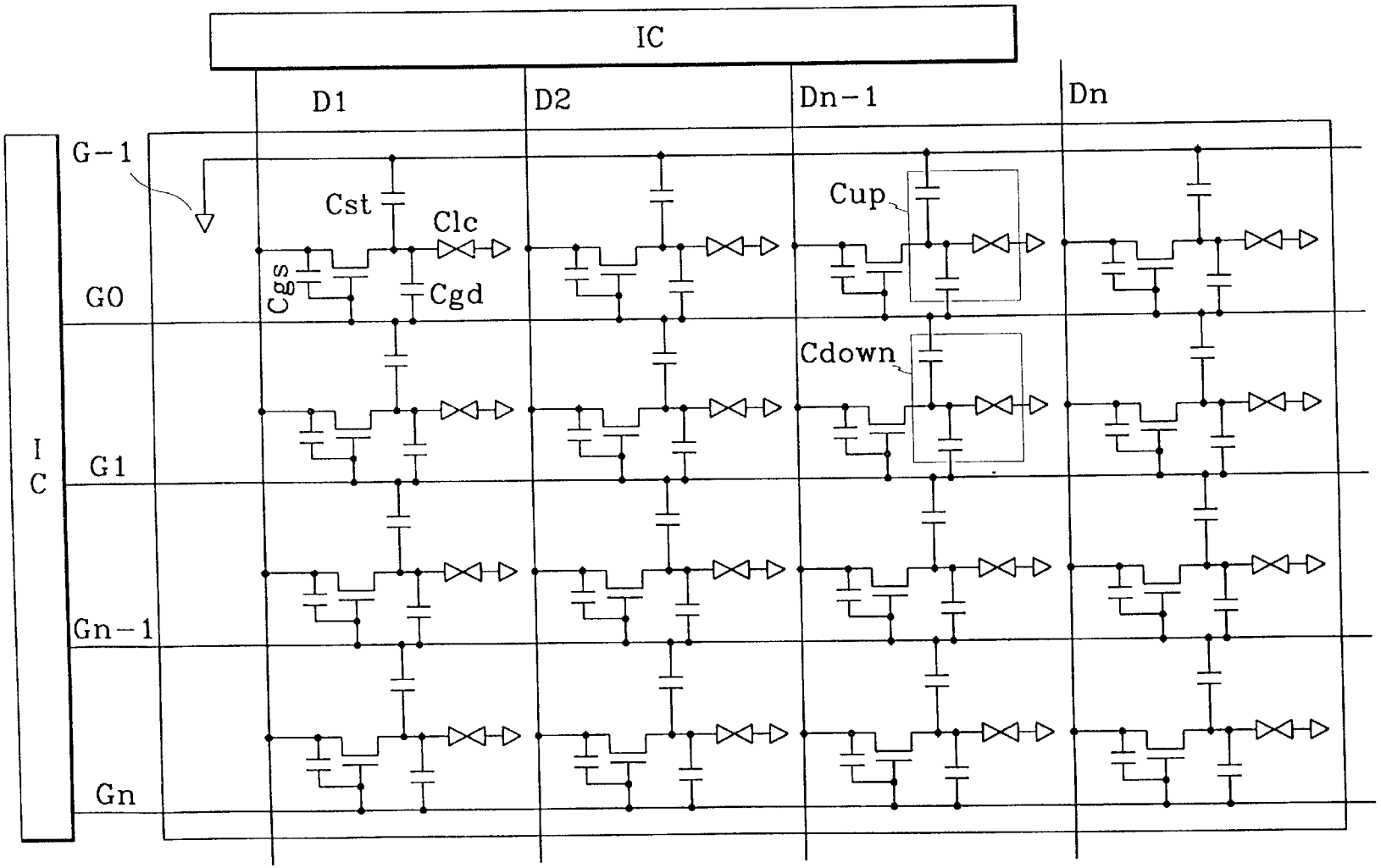
FIG. 3 is an electrical schematic of a TFT LCD display device according to a first embodiment of the present invention.
Figure 4:
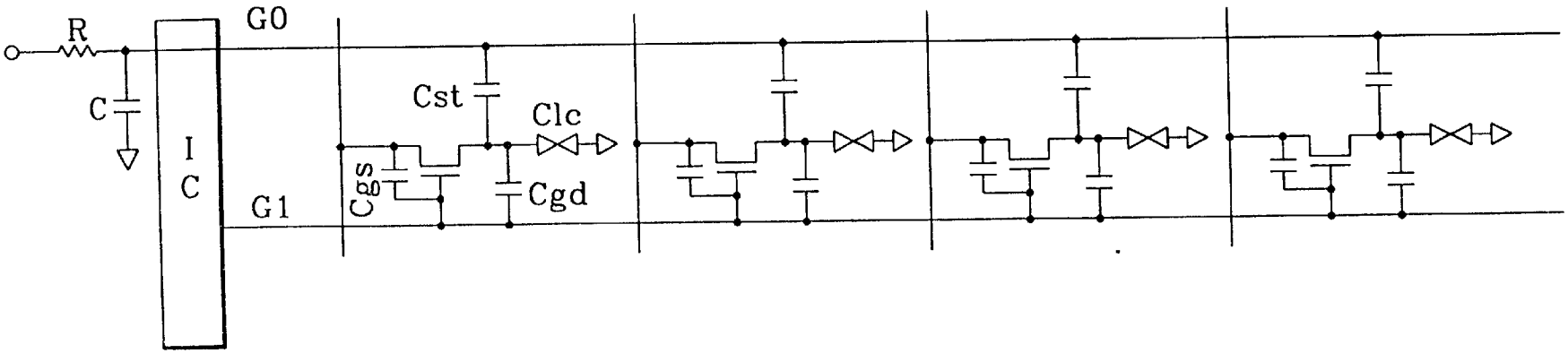
FIG. 4 is an electrical schematic of a TFT LCD display device according to a second embodiment of the present invention.

Referring to FIGS. 3–4, preferred embodiments of the present invention will now be described. In particular, FIG. 3 illustrates a TFT LCD display device according to a first preferred embodiment of the present invention. Here, a first row of viewable liquid crystal display cells are provided having data inputs electrically connected to a plurality of data lines (D1-Dn), control gates (i.e., gate electrodes) commonly connected to a first gate line (e.g., G1) and storage capacitors (Cst) having first electrodes electrically connected to a zeroth gate line (e.g., G0) and second electrodes electrically connected to respective pixel electrodes internal to the cells. A second row of viewable liquid crystal display cells are also provided having data inputs electrically connected to a plurality of data lines (D1-Dn), control gates commonly connected to a second gate line (e.g., G2) and storage capacitors (Cst) having first electrodes electrically connected to the first gate line (e.g., G1). Moreover, to maintain the RC delay value of the zeroth gate line at a level equal to the RC delay values associated with the higher order gate lines (e.g., G1-Gn), a row of nonviewable or "dummy" liquid crystal display cells (illustrated as the top row) are provided having data inputs electrically connected to the plurality of data lines, control gates commonly connected to the zeroth gate line Go and storage capacitors having first electrodes electrically coupled together. These "dummy" display cells may be rendered nonviewable by masking them with a black matrix in a color filter substrate, for example.

Here, the row of nonviewable cells are provided to "mimic" a row of viewable cells so that the RC delay value associated with the zeroth gate line equals the RC delay values associated with the other gate lines in the array. According to another aspect of this first embodiment, the first electrodes of the storage capacitors may be coupled together and to a reference signal line (e.g., Vcom) or they may float electrically relative to the zeroth gate line GO and high order gate lines G1-Gn.

FIG. 4 illustrates a TFT LCD display device according to a second preferred embodiment of the present invention. According to this second embodiment, a variable resistance device "R" (e.g., potentiometer, resistor ladder, etc.) and a variable capacitance device "C" are provided so that the total effective RC delay value associated with the zeroth gate line can be made to equal the RC delay values associated with the other gate lines. Here, the variable devices are electrically coupled in series between the zeroth gate line and respective reference potentials (e.g., Vcom, GND, etc.), as illustrated. Preferably, the variable resistance and capacitance devices are provided external to a display panel comprising the array of display cells. By making the RC delay values for all gate lines the same, display devices having reduced susceptibility to display deterioration can be achieved.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A liquid crystal display device, comprising:

a liquid crystal display panel including:

a first row of viewable liquid crystal display cells having data inputs electrically connected to a plurality of data lines, control gates commonly connected to a first gate line and storage capacitors having first electrodes electrically connected to a zeroth gate line;

a second row of viewable liquid crystal display cells having data inputs electrically connected to the plurality of data lines, control gates commonly connected to a second gate line and storage capacitors having first electrodes electrically connected to the first gate line;

a gate line driving circuit electrically coupled to the first and second gate lines;

a variable resistance device external to said display panel and said gate line driving circuit and electrically coupled in series between the zeroth gate line and a first reference potential, and a variable capacitance device external to said display panel and said gate line driving circuit and electrically coupled in series between the zeroth gate line and a second reference potential:

wherein said gate line driving circuit is not electrically connected to the zeroth gate line.

2. The display device of claim 1, wherein the first reference potential equals the second reference potential.

3. This display device of claim 1, wherein the zeroth gate line is not electrically connected to any control gates of display cells in said liquid crystal display panel.

4. A liquid crystal display device, comprising:

a liquid crystal display panel including:

a first row of viewable liquid crystal display cells having data inputs electrically connected to a plurality of data lines, control gates commonly connected to a first gate line and storage capacitors having first electrodes electrically connected to a zeroth gate line;

a second row of viewable liquid crystal display cells having data inputs electrically connected to the plurality of data lines, control gates commonly connected to a second gate line and storage capacitors having first electrodes electrically connected to the first gate line;

a gate line driving circuit electrically coupled to the first and second gate lines;

a variable resistance device external to said display panel and said gate line driving circuit and electrically coupled in series between the zeroth gate line and a first reference potential; and a variable capacitance device external to said display panel and said gate line driving circuit and electrically coupled in series between the zeroth gate line and a second reference potential;

wherein the zeroth gate line is not electrically connected to any control gates of display cells in said liquid crystal display panel.

* * * * *